United States Patent [19]

Grace

[11] Patent Number: 4,658,628

[45] Date of Patent: Apr. 21, 1987

[54] VEHICLE FRAME STRAIGHTENING APPARATUS

[76] Inventor: William G. Grace, 6263 Staheli Dr., Kelseyville, Calif. 95451

[21] Appl. No.: 718,043

[22] Filed: Mar. 29, 1985

[51] Int. Cl.[4] ..... B21D 1/12

[52] U.S. Cl. ..... 72/450; 72/705

[58] Field of Search ..... 254/228, 263; 72/705, 72/450

[56] References Cited

U.S. PATENT DOCUMENTS

| | | | |
|---|---|---|---|
| 3,492,855 | 2/1970 | Wylie | 72/705 |
| 3,796,084 | 3/1974 | Jarman | 72/705 |
| 3,906,777 | 9/1975 | Dickens | 72/705 |
| 4,257,255 | 3/1981 | Sanchez | 72/705 |

*Primary Examiner*—Lowell A. Larson

*Attorney, Agent, or Firm*—Townsend and Townsend

[57] ABSTRACT

Apparatus for straightening frames and sheet metal products including an upright post mounted on a base plate. A tubular member is adjustably mounted on the post for movement along the same. A fluid-actuated power device is secured to and extends laterally from the tubular member on the post, said power device including a piston rod extending outwardly from a fluid cylinder, the outer end of the piston rod being coupled to the adjacent ends of a pair of parallel bars which extend alongside the cylinder and in opposed directions away from the tubular member. A hook is secured to first ends of the bars and to first ends of a pair of braces so that, when the piston of the power device is moved away from the workpiece, a force will be exerted on the workpiece to tend to straighten it. During the time when the force is exerted on the workpiece, the apparatus is held down by a chain or other fastener to the floor on which the apparatus is mounted. A pair of braces are provided to provide a moment arm during application of the straightening force to the workpiece.

4 Claims, 3 Drawing Figures

VEHICLE FRAME STRAIGHTENING APPARATUS

This invention relates to improvements in the straightening of rigid frames and sheet metal products, such as the frames and doors of a vehicle and, more particularly, to apparatus for straightening a workpiece by the simultaneous application of several forces exerted by power devices.

BACKGROUND OF THE INVENTION

Straightening of vehicle frames or sheet metal products by mechanical apparatus is well known and has been done for a number of years. Generally, frame straightening machines are extremely bulky, require much space to operate, and represent a high capital cost to a body shop or other establishment. Such large machines are generally used even for the smallest frame straightening job and, when so operated, the machines are not efficiently used. Moreover, a machine of conventional size and shape usually must remain in one position at all times because it is so bulky and cannot be moved. Thus, the space occupied by such a machine is not efficiently used when the machine is not in operation.

In view of the drawbacks of the conventional, large straightening machines, a need has existed for an improved apparatus for use for frame or sheet metal straightening purposes where light to medium damage to a rigid frame or sheet metal has occurred. The present invention satisfies this need.

SUMMARY OF THE INVENTION

The present invention is directed to an improved apparatus for use in straightening rigid frames or sheet metal products that have been damaged. The apparatus includes an upright post having means for mounting the post in an upright position on a support surface, such as a concrete floor. A tubular member is adjustably mounted on the post for up and down movement with respect thereto. A pair of pulling bars are carried by a mounting means on the adjustable member, and a fluid-actuated power device, coupled to the pulling bars, is used to shift the bars along a transverse path with respect to the longitudinal axis of the upright post. When the power device is actuated to apply a force to first ends of the pulling bars, it causes a pulling force on a chain secured to the opposite ends of the bars while the post is rigidly secured by a chain or other hold down means to the support surface.

The mounting means for mounting the bars on the tubular member includes two sets of braces, one set being rigidly secured to the tubular member and to one end of a cross-piece rigid to the tubular member and projecting outwardly therefrom in opposite directions. The second set of braces is pivotally secured to the pulling ends of the pulling bars and to the opposite end of the cross-piece. A hook or other attaching means can be adjustably mounted on the second set of braces to vary the moment arm and thereby the force exerted on a pulling member, such as a chain, coupled with the hook or other attaching means.

The apparatus of the present invention provides repair work which can be done quickly and easily and at maximum efficiency. The apparatus is portable so that it can be readily moved from place to place, yet it is easy to operate and easy to store in a minimum of space. By using the apparatus, a workman need not use a large, conventional straightening machine, thereby leaving the large machine free for use straightening frames which have been heavily damaged.

The primary object of the present invention is to provide an improved straightening apparatus for frames and sheet metal products wherein the apparatus is simple and rugged in construction, is portable and can be operated efficiently for straightening frames and sheet metal products which have incurred light to medium damage so as to avoid the need to use relatively large, conventional straightening machines for small jobs.

Other objects of this invention will become apparent as the following specification progresses, reference being had to the accompanying drawings for an illustration of the invention.

IN THE DRAWINGS

Figures 2, 3:
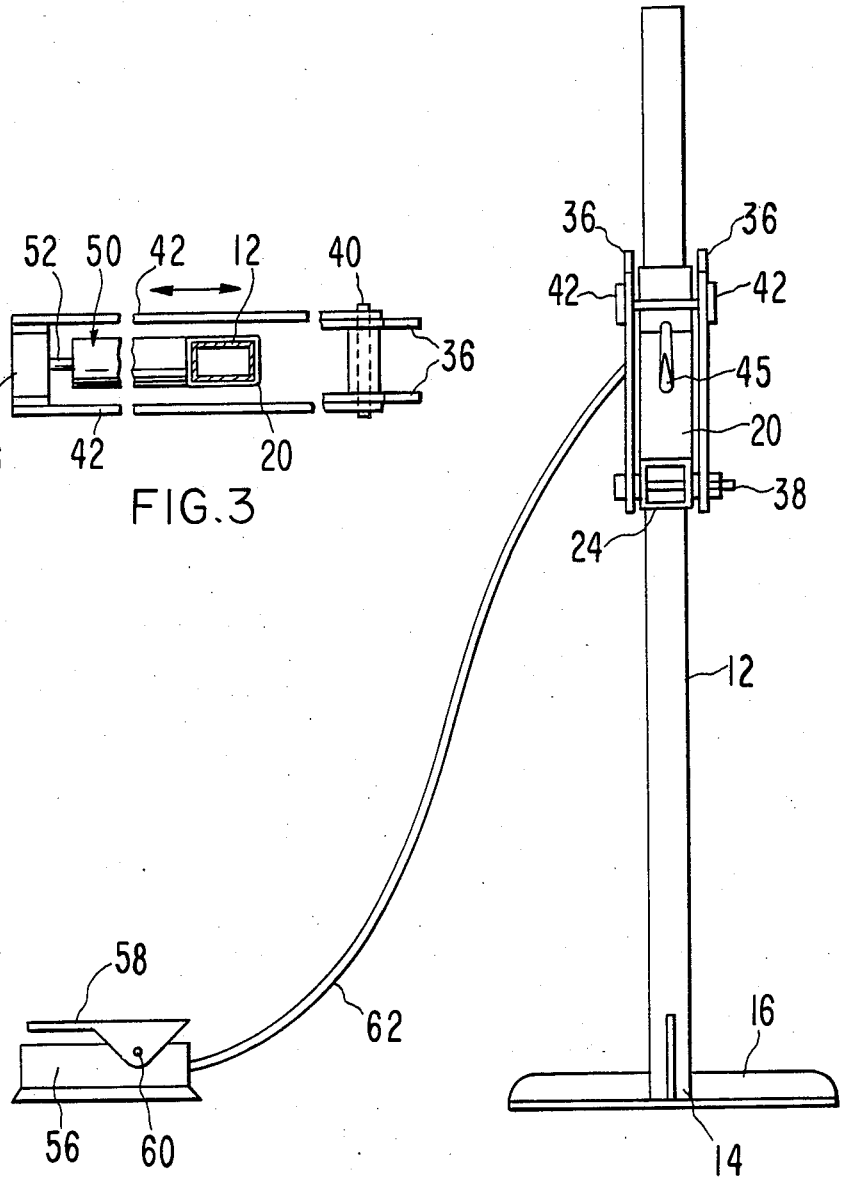
FIG. 2 is an end elevational view looking in the direction of line 2—2 of FIG. 1.
FIG. 3 is a cross-sectional view taken along line 3—3 of FIG. 1.

The frame straightening apparatus of the present invention is broadly denoted by the numeral 10 and includes an upright post 12 rigidly secured at its lower end 14 to a base plate 16 adapted to be placed on a supporting surface, such as a concrete floor. The post has a plurality of spaced holes 18 therethrough for adjustably mounting a tubular member 20 by means of a pin 22 which extends through corresponding holes in member 20. For purposes of illustration and as shown in FIG. 3, both posts 12 and member 20 are of rectangular or square cross-section, member 20 being slightly greater in inside dimensions than the outside dimensions of post 12, so that member 20 can move up and down along the length of the post to a desired operating position.

A second member or cross-piece 24 is secured to and extends laterally in opposite directions from the lower end of member 20. Member 24 is of a tubular cross-sectional configuration slightly greater than that of member 20 so that, when a pair of vertically spaced openings are formed in member 24, member 20 can be placed in the openings in the manner shown in FIG. 1, and then welded at locations 25 so that members 20 and 24 are rigidly secured to each other but are at right angles with respect to each other to form an inverted T-shaped configuration. Member 24 has a hole 26 which can also receive pin 22 to adjustably mount member 20 on post 12.

Figure 1:
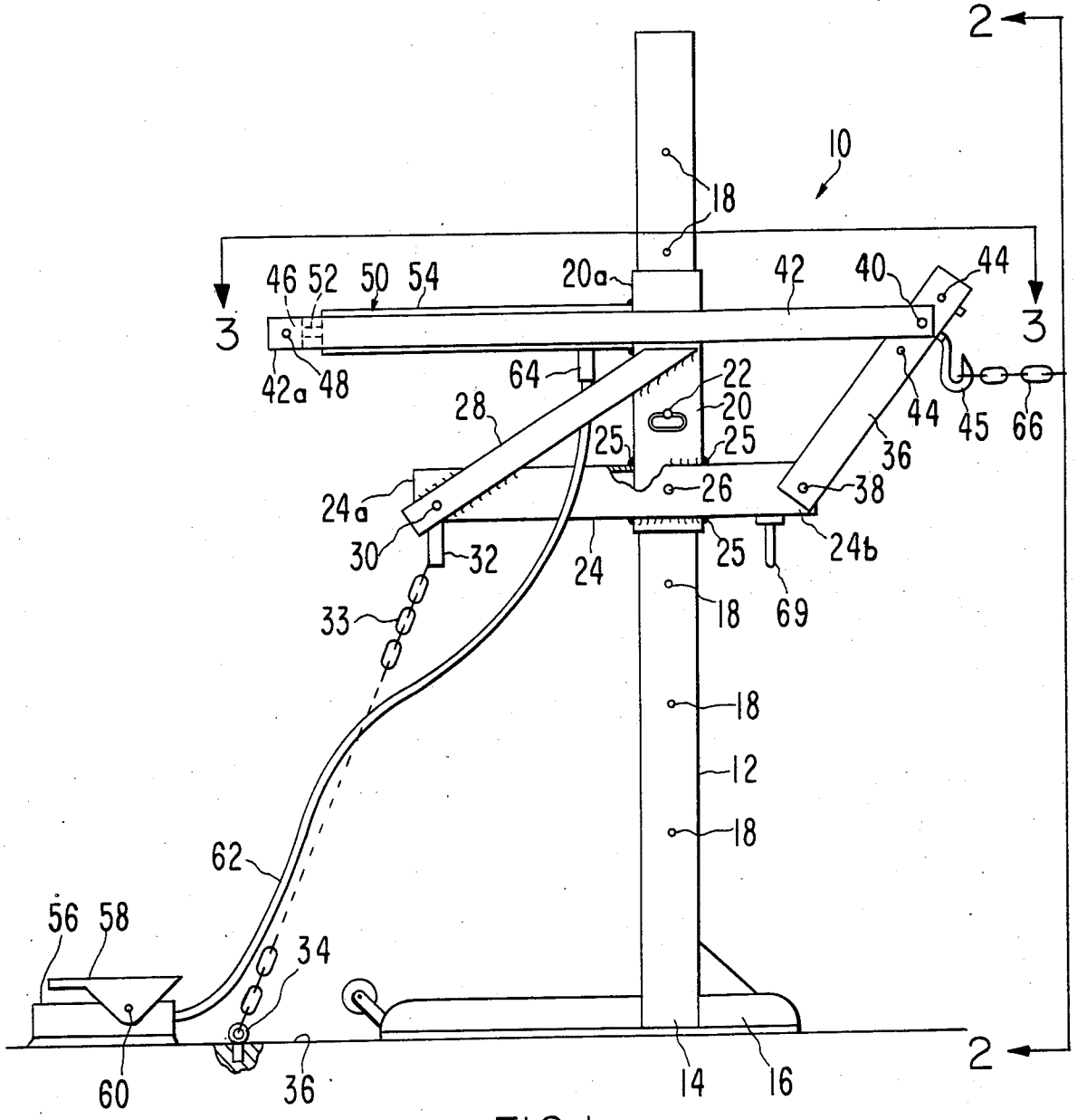
FIG. 1 is a side elevational view of the frame straightening apparatus of the present invention.

A pair of spaced, inclined braces 28 are welded or otherwise rigidly fixed at the ends thereof to respective sides of member 20. The braces 28, only one of which is shown in FIG. 3, extend downwardly toward the end **24*a* of member 24, which is spaced laterally from member 20, as shown in FIG. 1. A bolt 30 is used to mount a hook or other attaching means for use in attaching one end of an anchor chain 33 to apparatus 10, the opposite end of the anchor chain 33 adapted to be coupled to an eyelet 34 which is secured in some suitable manner to the floor 36 on which base plate 16** is mounted.

At the opposite end **24*b* of member 24, a pair of inclined braces 36 are provided, the lower ends of braces 36 being secured by a bolt 38 to end 24*b*. The opposite or upper ends of braces 36 are adapted to be coupled by a pin 40 to the adjacent or pulling ends of a pair of rigid pulling bars 42, which are generally parallel with cross-piece 24 and spaced above the latter. Braces 36 have spaced holes 44 therein at various locations along the length thereof near the upper ends. These holes permit a hook 45 or other attaching means to be adjustably coupled to the braces 36 and thereby to the adjacent ends of bars 42**.

Bars 42 extend on opposite sides of member 20 and are shiftable transversely relative to the member. The opposite ends 42*a* of bars 42 are coupled to a block 46 secured by a bolt 48 to the bars. A power device in the form of a fluid piston and cylinder assembly 50 having a piston rod 52 and a cylinder 54 is carried between bars 42 and between member 20 and block 46. The inner end of cylinder 54 is rigidly secured in some suitable manner to member 20 so that cylinder 54 is generally parallel with cross-piece 24.

The cylinder is controlled by a foot-actuated valve 56 mounted on surface 36, the valve having a foot pedal 58 which is pivoted about a pin 60 for pumping hydraulic fluid through a pipe 62 coupled to the inlet 64 of cylinder 54. By pumping on foot pedal 58, hydraulic fluid entering the cylinder 54 can cause the piston in the cylinder to advance piston rod 52 to the left when viewing FIG. 1, thereby causing movement of bars 42 to the left when viewing FIG. 1 and effecting a pulling action on braces 36 to cause them to pivot in a counterclockwise sense around the axis of bolt 38.

The moment arm formed by braces 36 can be varied in magnitude by changing the position of the hook 45, such as by mounting the hook on bolt 40 or on a bolt in either of holes 44. The greatest pulling force will be achieved when the hook is attached to a bolt in the lower hole 44.

In use, a pulling chain 66 is secured to a hook 45 coupled to the outer ends of each brace 36. A hold-down chain 70 is secured to hook 32 and to eyelet 34 (FIG. 1), and the chain 66 is coupled to the frame, such as a vehicle frame to be straightened. A safety chain (not shown) could be coupled to the vehicle and to a hook 69 on cross-piece 24. The pulling force exerted by apparatus 10 is for the purpose of straightening the frame of the vehicle by virtue of the horizontal pull applied on chain 66, the forward end of the chain 66 being coupled to the frame to be straightened.

The apparatus is operated by pumping on foot pedal 58, causing the flow of hydraulic fluid into cylinder 54 to move bars 42 to the left when viewing FIG. 1 and in turn, causing braces 36 to rotate in a counterclockwise sense, exerting a leftward pull on chain 66. The tension exerted by the frame on chain 66 is counterbalanced by the tension on chain 70, chain 70 having a horizontal component because it is inclined.

After the frame has been straightened, the apparatus 10 can be shifted in position to another portion of the frame to be straightened, and the above series of steps is repeated. It may be desirable or necessary to change the effective moment arm of braces 36 with respect to the pulling force exerted by bars 42, in which case hook 45 is moved into a different operative position along braces 36. Moreover, the height of member 20 relative to post 12 can be adjusted by removing pin 22 and moving the member 20 up or down until another desired position is reached.

Apparatus 10 provides an improved, efficient machine for straightening rigid frames of many different types. It is portable, easy to operate and easy to store. It is especially suitable for use with light to medium damage repair jobs on vehicles with separate frames.

I claim:

1. A straightening apparatus for rigid frames and sheet metal products comprising:

a post having means for mounting the post on a support surface in an upright position;

a member adjustably mounted on and movable along the post;

means for releasably coupling the member on the post;

a rigid element rigid to the member, the element extending outwardly from the member in opposed directions;

a fluid-actuated power device extending laterally from the member;

a pair of pulling bars extending generally longitudinally of the power device and projecting laterally from the member in opposite directions;

means coupling the outer end of the power device to adjacent ends of the bars;

a pair of inclined braces pivotally coupled at the first ends thereof to one end of the element, there being means adjustably and pivotally coupling the opposite ends of said bars to the braces near second ends thereof, whereby the leverage provided by said power device and said element can be varied;

an attaching device adjustably coupled to the braces near second ends thereof; and means coupled with the opposite end of the element for attaching the post to a fixed support.

2. Apparatus as set forth in claim 1, the braces having a number of spaced holes therethrough, said adjustable and pivotal coupling means including a bolt selectively received in the spaced holes of the braces.

3. Apparatus as set forth in claim 1, wherein is included a tubular unit member defining the element, said attaching means including a safety chain.

4. Apparatus as set forth in claim 3, wherein is included a second pair of braces rigidly secured to respective sides of the tubular unit and to the member.

* * * * *